356-400 SR
2/3/87 XR 4,641,272

United States Patent [19]

Sasaki et al.

[11] Patent Number: 4,641,272

[45] Date of Patent: Feb. 3, 1987

[54] DEVICE FOR SENSING SHEET TRANSPORT CONDITION

[75] Inventors: Tomio Sasaki, Kawasaki; Yukio Noguchi, Yokohama, both of Japan

[73] Assignee: Ricoh Company, Ltd., Tokyo, Japan

[21] Appl. No.: 594,151

[22] Filed: Mar. 28, 1984

[30] Foreign Application Priority Data

Apr. 5, 1983 [JP] Japan ..... 58-59430

[51] Int. Cl.[4] ..... G06F 15/46; B65H 23/032; B65H 23/18

[52] U.S. Cl. ..... 364/559; 250/561; 355/14 SH; 356/400; 364/478

[58] Field of Search ..... 364/478, 550, 559; 355/14 SH; 356/400; 250/548, 557, 561

[56] References Cited

U.S. PATENT DOCUMENTS 3,912,193 10/1975 Calver ..... 250/548 X
4,146,797 3/1979 Nakagawa ..... 250/548
4,201,378 5/1980 Hams ..... 250/561 X
4,303,189 12/1981 Wiley et al. ..... 250/548 X
4,518,862 5/1985 Dorn ..... 250/561

*Primary Examiner*—Felix D. Gruber
*Assistant Examiner*—Kevin J. Teska
*Attorney, Agent, or Firm*—David G. Alexander

[57] ABSTRACT

In an electrophotographic copier, while a document is transported toward a predetermined position on a glass platen, its lateral dislocation and skew with respect to a document transport path as well as an amount of the dislocation and a direction of the skew are commonly sensed by a single sensor. The single sensor is positioned adjacent to one of laterally opposite ends of the transport path and has sensing surface of a predetermined area. While the document moves past the sensing surface of the sensor, the sensor generates a signal which corresponds to an area of the sensing surface which is occupied by the sheet.

8 Claims, 10 Drawing Figures

DEVICE FOR SENSING SHEET TRANSPORT CONDITION

BACKGROUND OF THE INVENTION

The present invention relates to a device associated with a copier, printer or like machine for sensing lateral dislocation and skew of a sheet such as an original document or a copy sheet which is being transported toward a predetermined position in the machine.

An automatic document feeder (ADF) installed in a prior art electrophotographic copier automatically feeds a document to a predetermined position on a glass platen by means of belts. In the automatic document feeder, at least two sensors are positioned face-to-face at laterally opposite sides of a sheet transport path in order to sense passage of the document being transported. Skew of the document on the transport path is sensed in terms of a difference between the times when the document moves past the sensors, e.g. difference between the times when the sensors have started sensing the document in movement. Also installed in the prior art automatic document feeder are an array of parallel sensors which are arranged in a direction perpendicular to an intended direction of document feed, that is, laterally with respect to the transport path. This parallel sensor array functions to check for any lateral displacement of the document in the transport path by sensing that the number of the sensors which detected the passage of the document differs from a predetermined number, i.e. the number of the sensors which sense a document in a proper transport condition. An automatic document feeder with such a function of sensing a document transport condition is quite useful and has been extensively used.

However, a problem has been encountered with the above-described described prior art device in that independent sensors have to be employed in order to sense at least the skew and lateral dislocation of a document and, moreover, a plurality of sensors are required for each of the skew and lateral dislocation.

SUMMARY OF THE INVENTION

It is therefore an object of the present invention to provide a device for sensing a sheet transport condition which is capable of sensing lateral dislocation of a sheet being transported and its amount and skew of the sheet and its direction at the same time by means of a single sensor, which has a sensing surface of a predetermined area.

It is another object of the present invention to provide a generally improved device for sensing a sheet transport condition.

A device for sensing a transport condition of a sheet, which is being transported along a predetermined transport path, with respect to a transport direction of the present invention comprises a single sensor located in the vicinity of one of laterally opposite ends of the transport path and having a sensing surface which extends over a predetermined area, the single sensor continuously generating a detection signal corresponding to an area of the sensing surface which is occupied by the sheet while the sheet moves past the sensing surface, a plurality of comparators each being supplied with the detection signal to compare a level of the detection signal with different reference levels which are respectively assigned to the comparators, each of the comparators continuously generating a comparison signal only for a duration in which the level of the detection signal is higher than the reference level assigned thereto, and computer means for comparing a number of the comparators which are generating the comparison signals with a predetermined reference number of the comparators which generate comparison signals while the sheet is in proper transportation, and computing lateral dislocation of the sheet with respect to the transport direction and an amount of the lateral dislocation from a result of the comparison.

The above and other objects, features and advantages of the present invention will become apparent from the following detailed description taken with the accompanying drawings.

DESCRIPTION OF THE PREFERRED EMBODIMENT

While the device for sensing a sheet transport condition of the present invention is susceptible of numerous physical embodiments, depending upon the environment and requirements of use, a substantial number of the herein shown and described embodiment have been made, tested and used, and all have performed in an eminently satisfactory manner.

Figure 1:
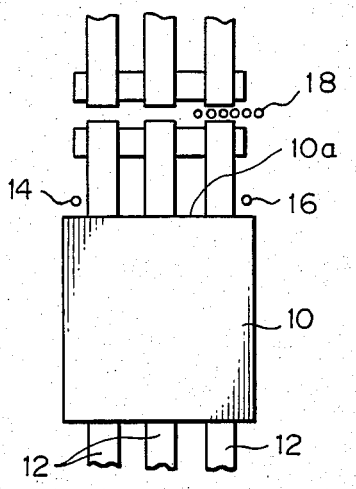
Fig. 1 PRIOR ART
FIG. 1 is a view of a prior art sheet transport condition sensor arrangement in which a number of sensors are arranged in a path along which a sheet is conveyed.

As shown in FIG. 1, in an automatic document feeder equipped within a prior art electrophotographic copier, for example, belts 12 transport a document 10 along a predetermined transport path, while at least two sensors 14 and 16 are located at laterally opposite sides of the transport path to sense passage of the document 10. Each of the sensors 14 and 16 comprises a light emitting element and a light receiving element. Further, a plurality of sensors 18 are arranged parallel in an array which is perpendicular to the intended direction of sheet transport. The sensors 14 and 16 are adapted for the detection of skew of the document 10, while the sensors 18 are adapted for the detection of lateral dislocation of the document 10. The document 10 will be determined to be skewed when the two sensors 14 and 16 fail to simultaneously sense the passage of the front end 10*a* of the document 10; the skew will be leftwardly upwardly, or rightwardly downwardly, when the sensor 14 senses the passage of the document end 10*a* before the sensor 16 and rightwardly upwardly, or leftwardly downwardly, when the sensor 16 senses it before the sensor 14. Meanwhile, any lateral disclocation of the document 10 in the transport path is decided when the number of the sensors 18 which have detected the passage of the document does not coincide with a predetermined number of the sensors 18 which will sense the sheet 10 in a proper sheet transport condition. In the illustrated arrangement, the document 10 will be determined to be in leftward dislocation with respect to the direction of movement when the number of the sensors 18 which sensed the passage of the document 10 is smaller than the predetermined number, and in rightward dislocation when the former is larger than the latter. The amount of such lateral dislocation is represented by a specific number of the sensors 18 which sensed the passage of the document 10.

In the above-described prior art device, at least two sensors have to be assigned for the detection of skew of a document being conveyed and a greatest possible number of sensors have to be employed to accurately sense lateral dislocation, particularly an amount thereof.

Hereinafter will be described a sheet transport condition sensing device embodying the present invention which is free from the drawback discussed above. While the description will focus on an application of the present invention to an automatic document feeder associated with an electrophotographic copier, it should be noted that such is not limitative and only illustrative.

Figure 2:
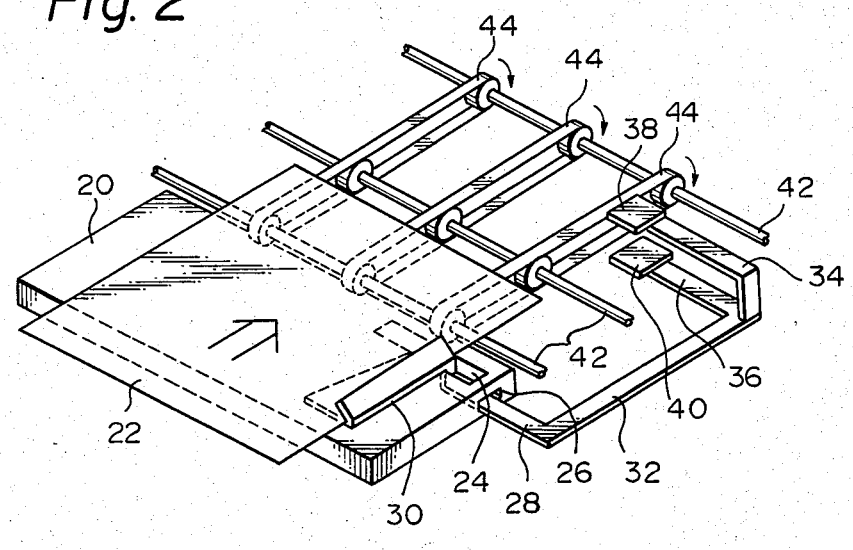
FIG. 2 is a perspective view of a device for sensing a sheet transport condition embodying the present invention in which a single sensor is positioned in a sheet transport path.

Referring to FIG. 2, a table 20 for loading a document is formed with a groove or channel 24 in an upper right portion thereof which extends in a direction perpendicular to an intended direction of document feed, indicated by an arrow in the drawing. The table 20 is also formed with an opening 26 which extends from the groove 24 to the right end of the table 20 as illustrated. A connecting member 28 is slidably received in the groove 24. Connected to one end of the connecting member 28 is a document guide 30 which is slidably laid on the table 20. The other end of the connecting member 28 protrudes from the opening 26 to terminate at one end of an arm member 32. Support members 34 and 36 extend parallel from the other end of the arm member 32 as far as a position where they will face the document 22 from above and below. The support member 34 carries a light emitting element 38 at its end and the support member 36, a light receiving element 40 having a predetermined light receiving surface. Belts 44 are caused to rotate by a drive shaft 42.

The light receiving element 40 comprises, for example, a photodiode having a predetermined light receiving area. The output voltage of the light receiving element 40 represents a quantity of light from the light emitting element 38 which is intercepted by the document 22, that is, an area of the light receiving surface which is occupied by the document 22.

Figure 3:
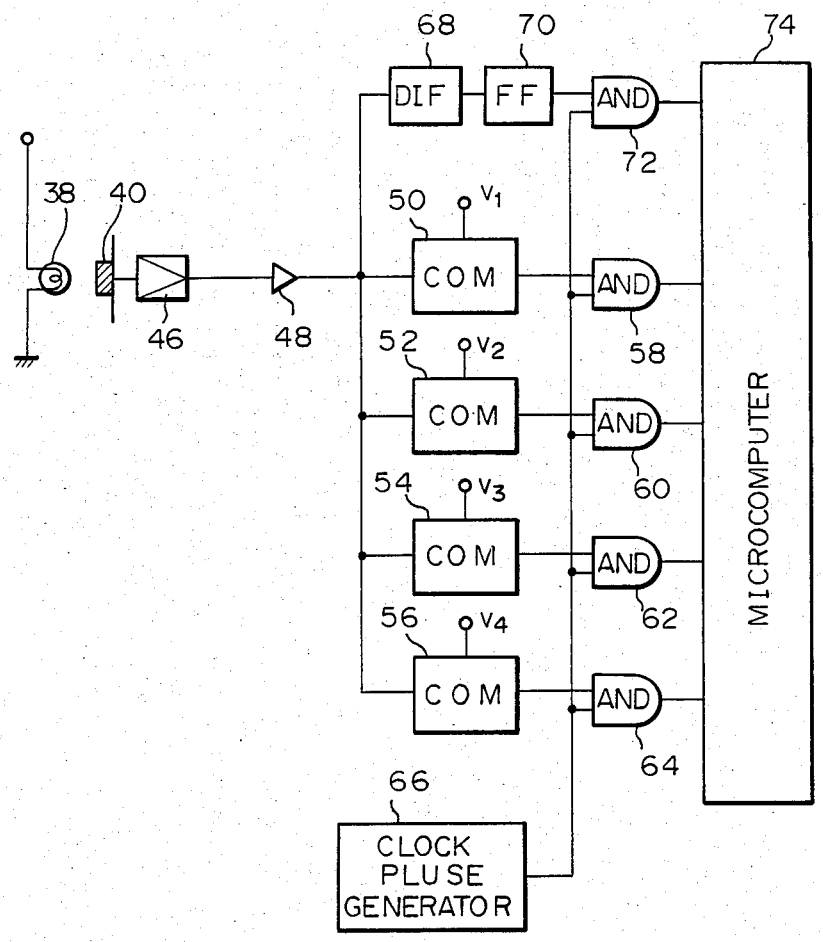
FIG. 3 is a diagram of a control circuit in accordance with the embodiment shown in FIG. 2.

Referring to FIG. 3, a control circuit is shown which is associated with the document transport condition sensing device of the present invention. The output voltage of the light receiving element 40 is applied to an amplifier 46 to be amplified thereby. The output of the amplifier 46 is fed to a buffer amplifier 48 so that fluctuation thereof is suppressed. The output voltage of the buffer amplifier 48 is compared by comparators 50, 52, 54 and 56 with predetermined reference voltages (threshold levels) $v_1$, $v_2$, $v_3$ and $v_4$ respectively. Each of the comparators 50, 52, 54 and 56 develops a high level output when the incoming buffer amplifier output is lower than the reference level assigned thereto. The reference voltages are preselected to be in a relation $v_1 > v_2 > v_3 > v_4$. Outputs of the comparators 50, 52, 54 and 56 are applied to one input terminals of AND gates 58, 60, 62 and 64, respectively. Applied to the other input terminals of the AND gates 58, 60, 62 and 64 are an output of a clock pulse generator 66. In this construction, clock pulses from the clock pulse generator 66 are applied to the AND gates 58, 60, 62 and 64 only when the comparators 50, 52, 54 and 56 commonly produce high level outputs.

The output of the buffer amplifier 48 is also routed to a differentiator 68 and, therethrough, to a flip-flop 70. While the output voltage of the differentiator 68 remains positive, the flip-flop 70 develops a high level output. The output of the flip-flop 70 is applied to one input terminal of an AND gate 72 the other input terminal of which receives clock pulses from the clock pulse generator 66. Only when the output of the flip-flop 70 is high level, the AND gate 72 gates the clock pulses from the clock pulse generator 66.

A microcomputer 74 determines a direction and amount of lateral dislocation of the document 22 in terms of the number of AND gates 58, 60, 62 and 64 which are gating clock pulses, that is, the number of comparators 50, 52, 54 and 56 which are developing high level outputs. The microcomputer 74 also counts the clock pulses output from each of the AND gates 58, 60, 62 and 64 independently of the others and, comparing each count with a predetermined first reference number of pulses, checks for skew of the document 22. Further, the microcomputer 74 counts clock pulses output from the AND gate 72 and compares the count with a predetermined second reference number of pulses, thereby determining a direction of the skew. Signals representative of such various sheet transport conditions are fed out from the microcomputer 74. The concrete operation of the microcomputer 74 will be described later.

Figure 4:
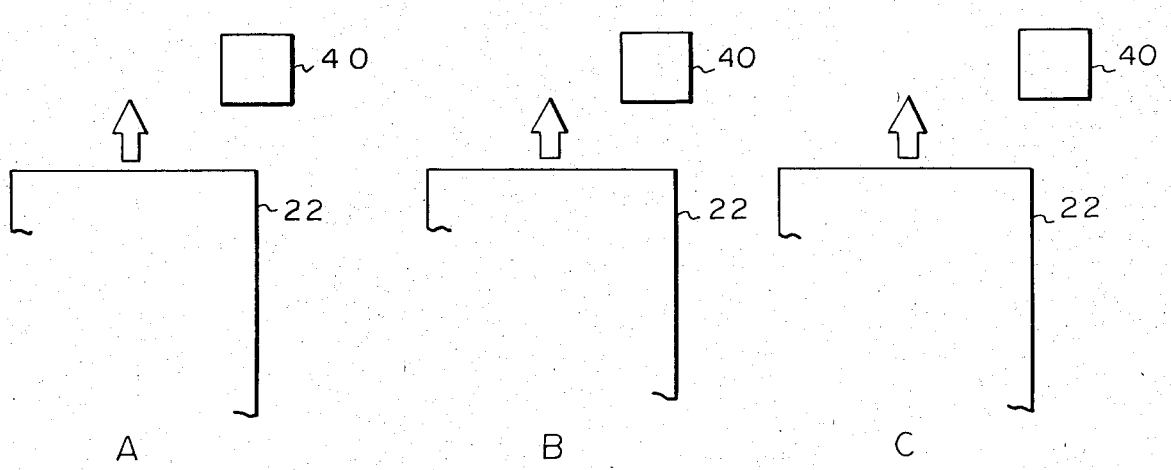
FIGS. 4, 6 and 8 are diagrams showing various conditions, or positions, of a sheet in transportation.
Figure 5:
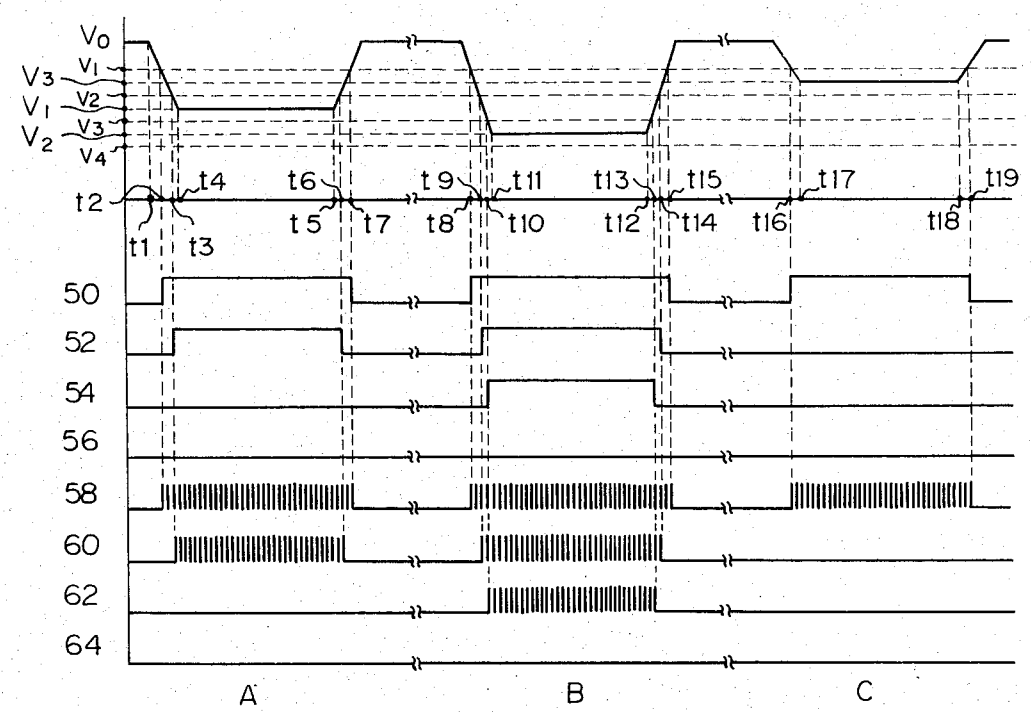
FIGS. 5, 7 and 9 are timing charts representative of operations of the control circuit shown in FIG. 3 which correspond to the sheet transport conditions of FIGS. 4, 6 and 8 respectively.

In operation, assume that the document 22 is being transported in a proper position as indicated by A in FIG. 4. Then, as indicated by A in FIG. 5, the output voltage of the amplifier 48 lowers to the lowest level $V_1$ ($>v_3$) for a period between times $t_4$ and $t_5$, so that the comparators 50 and 52 whose reference voltages are higher than $V_1$ are caused to develop high level outputs ($t_2-t_7$, $t_3-t_6$). As a result, the AND gates 58 and 60 individually deliver clock pulses as indicated by A in FIG. 5.

Where the document 22 is skewed with respect to the transport direction as indicated by a position B in FIG. 4, the output voltage of the amplifier 48 reaches the lowest level $V_2$ ($>v_4$) for the duration between times $t_{11}$ and $t_{12}$ ($=t_4-t_5$) as indicated by B in FIG. 5. Under this condition, the comparators 50, 52 and 54 having reference voltages which are higher than $V_2$ produce high level voltages ($t_8-t_{15}$, $t_9-t_{14}$, $t_{10}-t_{13}$), whereby the AND gates 58, 60 and 62 deliver clock pulses as indicated by B in FIG. 5.

Likewise, where the document 22 is skewed to the left with respect to the transport direction as indicated by a position C in FIG. 4, the output voltage of the amplifier 48 drops to the lowest level $V_3$ ($>v_2$) between times $t_{17}$ and $t_{18}$ ($=t_4-t_5$) as represented by C FIG. 5. As a result, the comparator 50 the reference voltage assigned thereto is higher than $V_3$ produces a high level voltage ($t_{16}-t_{19}$), causing the AND gate 58 to produce clock pulses as indicated by C in FIG. 5.

In this manner, the number of AND gates 58, 60, 62 and 64 which deliver the clock pulses is dependent upon the direction and amount of lateral dislocation of the document 22. The microcomputer 74, therefore, determines the number of AND gates 58, 60, 62 and 64 which are delivering the clock pulses and, by comparing the number with a reference number of the AND gates which deliver clock pulses in a proper sheet transport condition, detects a direction and amount of lateral dislocation of the document 22, thereby producing signals indicative of the detected condition. More concretely, the document 22 is decided to be in rightward dislocation with respect to the transport direction if the detected number of the AND gates is larger than the reference number and in leftward dislocation if the former is smaller than the latter. The amount of such lateral dislocation is determined on the basis of the number of the detected AND gates.

Figure 6:
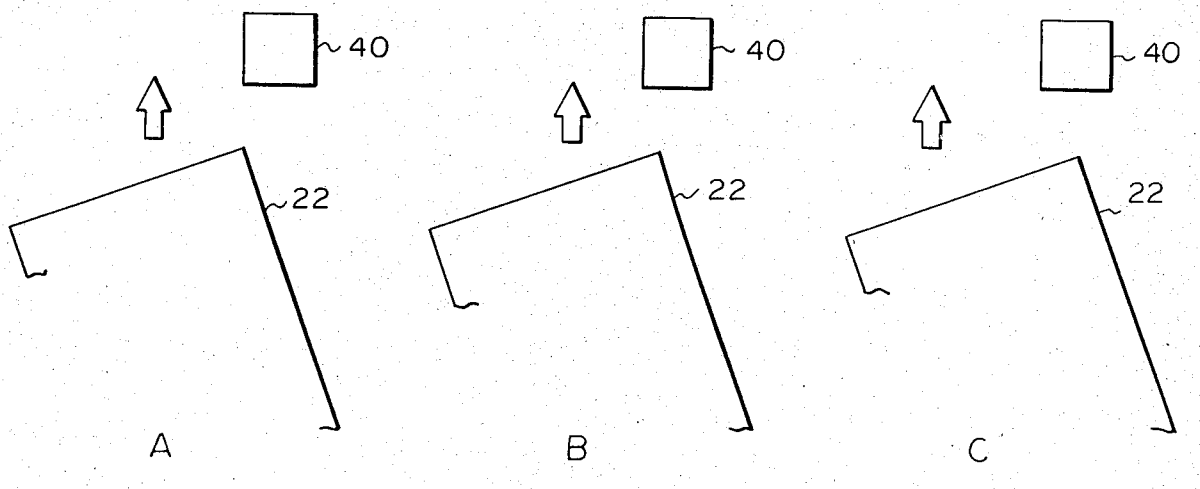
Figure 7:
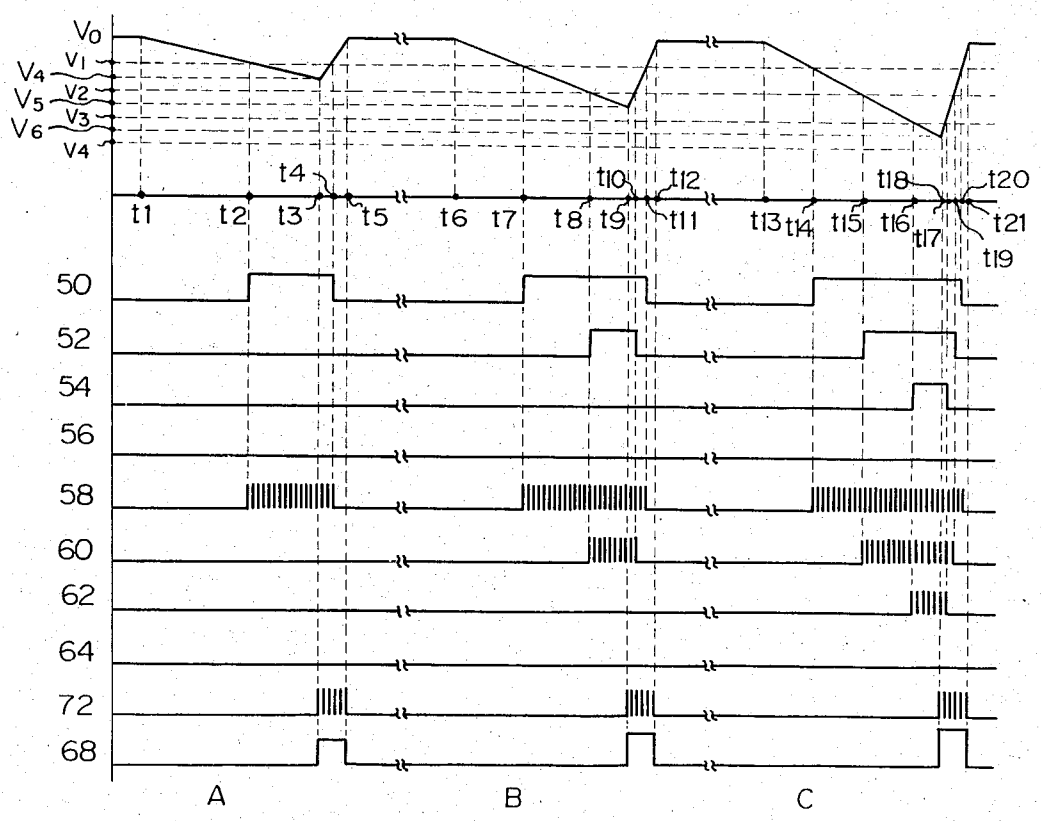

When the document 22 has skewed rightwardly upwardly (leftwardly downwardly) with respect to the transport direction as represented by a position A in FIG. 6, the output voltage of the amplifier 48 lowers to the lowest level $V_4$ ($>v_2$) at a time $t_3$ as represented by A in FIG. 7 so that the comparator 50 having a reference voltage higher than $V_4$ generates a high level voltage ($t_2-t_4$). This causes the AND gate 58 to deliver clock pulses as indicated by A in FIG. 7.

Likewise, when the document 22 in movement is laterally dislocated little by little from the position A of FIG. 6 to positions B and C, the output voltage of the amplifier 48 reaches the lowest level $V_5$ ($>v_3$) or $V_6$ ($>v_4$) at a time $t_9$ or $t_{17}$ as indicated by B or C in FIG. 7. Then, the comparators (50, 52) or (50, 52) or (50, 52, 54) whose reference voltages are higher than $V_5$ or $V_6$ generate high level voltages ($t_7-t_{11}$, $t_8-t_{10}$)or ($t_{14}-t_{20}$, $t_{15}-t_{19}$, $t_{16}-t_{18}$). Under this condition, the AND gates (58, 60) or (58, 60, 62) deliver clock pulses as shown in B or C in FIG. 7.

Meanwhile, in the event the document 22 has skewed rightwardly upwardly (leftwardly downwardly), the differentiator 68 develops a high level differentiated voltage for durations $t_3-t_5$, $t_9-t_{12}$ and $t_{17}-t_{21}$ whereby the flip-flop 70 is set to produce a high level signal for those durations. This causes the AND gate 72 to produce clock pulses as shown in FIG. 7.

Figure 8:
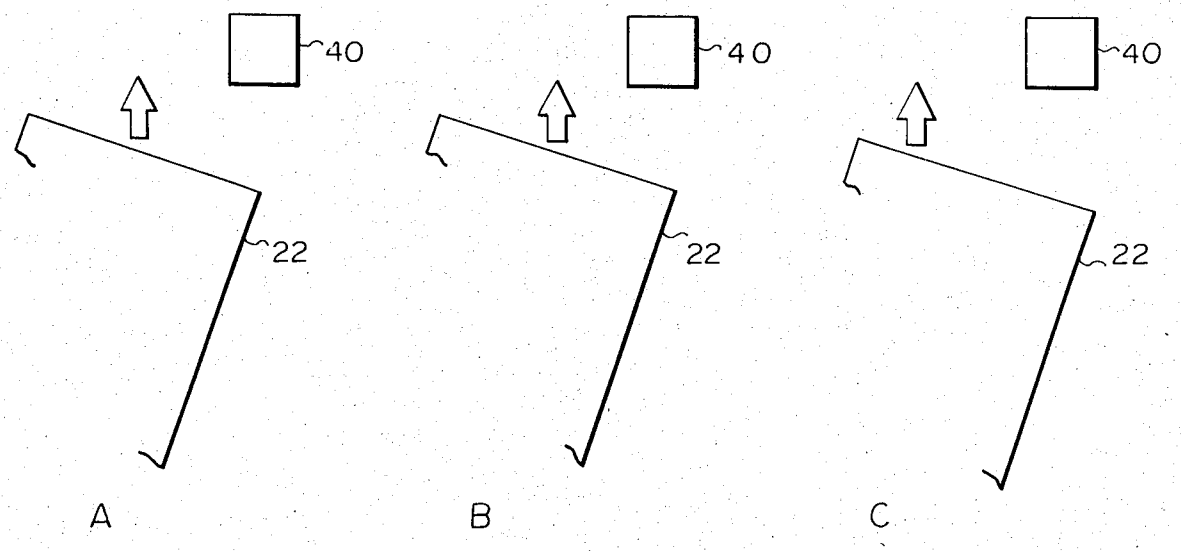

When the skew of the document 22 is rightwardly downwardly (leftwardly upwardly) as represented by positions A, B and C in FIG. 8, the output voltage of the amplifier 48 reaches the lowest levels $V_7$ ($>v_2$), $V_8$ ($>v_3$) or $V_9$ ($>v_4$). Then, the comparators (50), (50, 52) or (50, 52, 54) generate high level voltages ($t_2-t_4$), ($t_7-t_{11}$, $t_8-t_{10}$) or ($t_{14}-t_{20}$, $t_{15}-t_{19}$, $t_{16}-t_{18}$) and, hence, the AND gate (58) or AND gates (58, 60) or (58, 60, 62) deliver clock pulses as shown in A, B or C in FIG. 9. The differentiator 68, on the other hand, produces a high level differentiated voltage for durations $t_3-t_5$, $t_9-t_{12}$ and $t_{17}-t_{21}$ so that the flip-flop 70 is actuated to develop a high level signal for those durations. As a result, the AND gate 72 delivers clock pulses as shown in FIG. 8.

It will be seen from FIGS. 6–9 that, among the numbers of clock pulses output from the AND gates 58, 60, 62 and 64, the number of clock pulses output from at least one of the AND gates, that is, the pulse number output from an AND gate which is producing the smallest pulse number is, in the event of skew of the document 22, necessarily smaller than a number of clock pulses, N, corresponding to the number of pulses output from an AND gate for the duration $t_4-t_5$ of FIG. 4 ($=t_{11}-t_{12}$, $t_{17}-t_{18}$), that is, the pulse number output from the AND gate which is producing the smallest pulse number. With this principle, the microcomputer 74 stores therein the clock pulse number N and checks for the skew by comparing clock pulse numbers output from the AND gates 58, 60, 62 and 64 with the number N. If any one of the AND gates produces a clock pulse number smaller than N, the microcomputer 74 determines that the document 22 is skewed.

Figure 9:
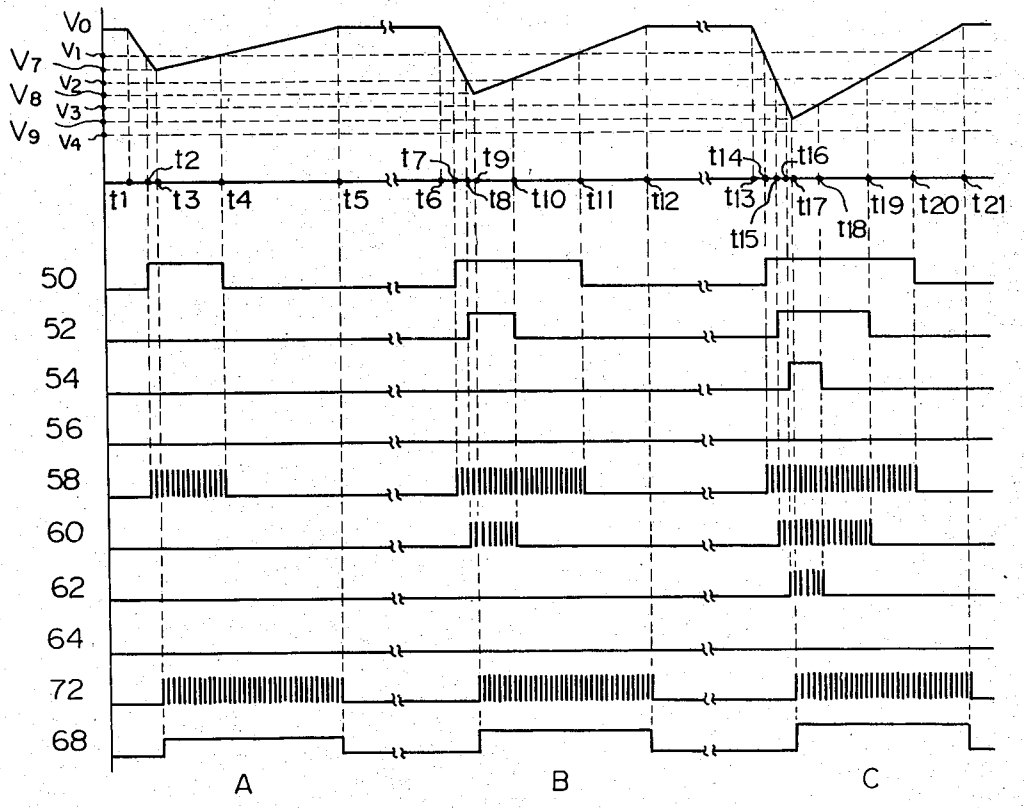

Upon detection of skew, the microcomputer 74 compares a number of clock pulses, X, output from the AND gate 72 with a number of clock pulses, M, stored therein which corresponds to a duration $(t_1-t_5)/2=((t_6-t_{12})/2, (t_{13}-t_{21})/2)$ shown in FIGS. 7 and 9, that is, a duration which is one half the period for which the document 22 moves past the light receiving surface of the light receiving element 40. If $M>X$, the microcomputer 74 sees that the skew is rightwardly upward (leftwardly downward) (see FIG. 6) and, if $M<X$, that the skew is rightwardly downward (leftwardly upward) (see FIG. 8). This is because, when the document 22 is on the rightwardly upward (leftwardly downward) skew, the number of clock pulses output from the AND gate 72 is smaller than the number M corresponding to the duration $(t_1-t_5)/2$ $(=(t_6-t_{12})/2, (t_{13}-t_{21})/2)$ as seen from FIG. 7 while, when the document is on the rightwardly downward (leftwardly upward) skew, the number of clock pulses is larger than the number M (see FIG. 9). The microcomputer generates signals indicative of the various sensed conditions.

Figure 10:
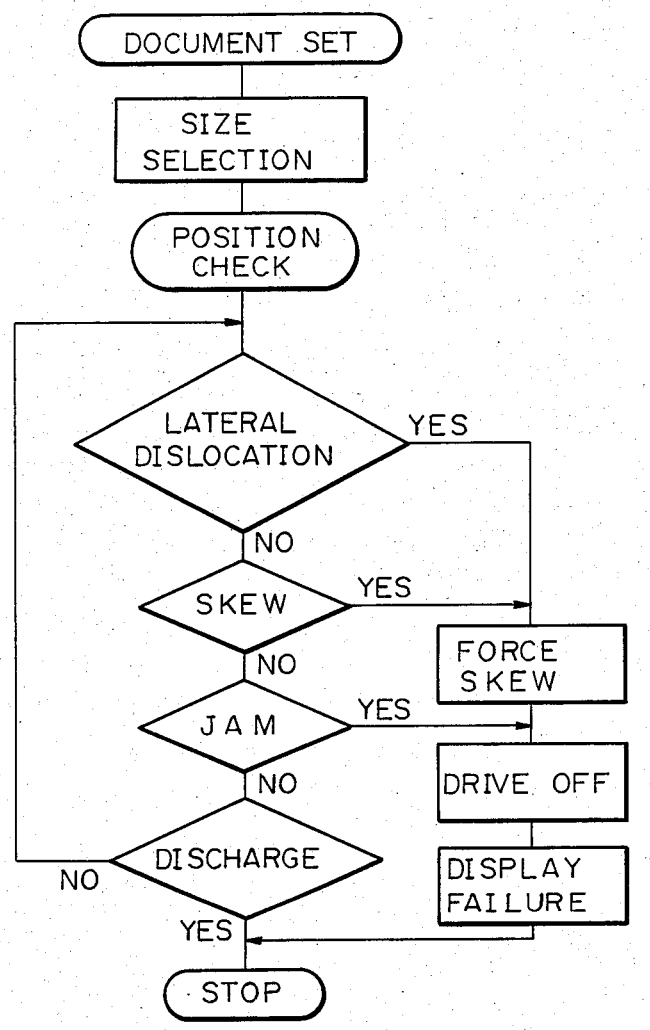
FIG. 10 is a flowchart demonstrating the operation of the embodiment of the present invention.

The operation of the present invention is shown in a flowchart in FIG. 10.

The document is first set in the feed position, the sheet size selected and the position checked. The document is then transported and checked for lateral dislocation and skew. If either is detected, the document is forcibly pushed toward the proper position by means which are not the subject matter of the present invention and are not illustrated or described in detail. If either lateral dislocation, skew or a sheet jam are detected, the drive is shut off and a failure display energized. During the document feed, whether or not the document has been discharged from the apparatus is constantly monitored, and the operation terminated upon detection of discharge.

In summary, it will be seen that the present invention provides a sheet transport condition sensing device which needs only a single sensor for sensing a lateral dislocation of a document or like sheet with respect to a direction of transport and an amount of the dislocation as well as skew of the sheet with respect to the transport direction and a direction of the skew.

Various modifications will become possible for those skilled in the art after receiving the teachings of the present disclosure without departing from the scope thereof.

What is claimed is:

1. A device for sensing a transport condition of a sheet, which is being transported along a predetermined transport path, with respect to a transport direction, said device comprising:

a single sensor located in the vicinity of one of laterally opposite ends of the transport path and having a sensing surface which extends over a predetermined area, said single sensor continuously generating a detection signal coresponding to an area of said sensing surface which is occupied by the sheet while the sheet moves past the sensing surface;

a plurality of comparators each being supplied with the detection signal to compare a level of the detection signal with different reference levels which are respectively assigned to said comparators, each of said comparators continuously generating a comparison signal only for a duration in which the level of the detection signal is higher than the reference level assigned thereto;

computer means for comparing a number of the comparators which are generating the comparison signals with a predetermined reference number of the comparators which generate comparison signals while the sheet is in proper transportation, and computing lateral dislocation of the sheet with respect to the transport direction and an amount of the lateral dislocation from a result of the comparison; and a differentiator having an input connected to the single sensor and an output connected to the computer means for generating a variation rate signal which corresponds to a variation rate in the level of the detection signal output from the single sensor, the computer means being constructed to compare a first predetermined period of time for which an area of the sensing surface of the sensor occupied by the sheet while the sheet properly moves past the sensing surface remains maximum with a duration of one of the comparison signals output from the comparators which is output for a shortest duration, and deciding that the sheet is skewed with respect to the transport direction when the first predetermined period is shorter than the duration of said one comparison output.

2. A device as claimed in claim 1, in which the computer means is further constructed to, when skew of the sheet is detected, compare a second predetermined period, which is one half a period which the sheet takes to properly move past the sensing surface of the sensor, with a duration of the variation rate signal output from the differentiator, and to determine a direction of the skew of the sheet with respect to the transport direction from a result of the comparison.

3. A device as claimed in claim 1, in which the single sensor is located in the vicinity of the rightmost end of the transport path with respect to the transport direction, the computer means being further constructed to decide that the sheet is skewed rightwardly upwardly (leftwardly downwardly) with respect to the transport direction when said second predetermined period is longer than the duration of the variation rate signal and that the sheet is skewed leftwardly upwardly (rightwardly downwardly) when the second predetermined period is shorter than the duration of the variation rate signal.

4. A device as claimed in claim 1, in which the single sensor is located in the vicinity of the leftmost end of the transport path with respect to the transport direction, the computer means being further constructed to decide that the sheet is skewed leftwardly upwardly (rightwardly downwardly) with respect to the transport direction when said second predetermined period is longer than the duration of the variation rate signal and that the sheet is skewed rightwardly upwardly (leftwardly downwardly) when the second predetermined period is shorter than the duration of the variation rate signal.

5. A device for sensing a transport condition of a sheet, which is being transported along a predetermined transport path, with respect to a transport direction, said device comprising;

a single sensor located in the vicinity of one of laterally opposite ends of the transport path and having a sensing surface which extends over a predetermined area, said single sensor continuously generating a detection signal corresponding to an area of said sensing surface which is occupied by the sheet while the sheet moves past the sensing surface;

a plurality of comparators each being supplied with the detection signal to compare a level of the detection signal with different reference levels which are respectively assigned to said comparators, each of said comparators continuously generating a comparison signal only for a duration in which the level of the detection signal is higher than the reference level assigned thereto;

computer means for comparing a number of the comparators which are generating the comparison signals with a predetermined reference number of the comparators which generate comparison signals while the sheet is in proper transportation, and computing lateral dislocation of the sheet with respect to the transport direction and an amount of he lateral dislocation from a result of the comparison; and a differentiator having an input connected to the single sensor for developing a variation rate signal indicative of a variation rate in the level of the detection signal output from the single sensor, a flip-flop having an input connected to an output of the differentiator for developing an output when variation rate signal is positive, a clock pulse generator for generating clock pulses, AND gates common in number to the comparators and supplied with the clock pulses and comparison signals output from the comparators, and an AND gate for receiving an output of said flip-flop and the clock pulses, outputs of said AND gates being supplied to the computer means, the computer means being constructed to compare a first predetermined number of clock pulses which are output from the clock pulse generator for a period in which an area of the sensing surface of the sensor occupied by the sheet when the sheet properly moves past the sensing surface remains maximum with a number of clock pulses which are output from the clock pulse generator for a duration of one of the comparison signals output from the comparators which is output for a shortest duration, and deciding that the sheet is skewed with respect to the transport direction when the first predetermined number of clock pulses is smaller than the number of clock pulses output from the clock pulse generator for said duration.

6. A device as claimed in claim 5, in which the computer means is further constructed to, when skew of the sheet is detected, compare a second predetermined number of clock pulses output from the clock pulse generator for a period which is one half a period which the sheet takes to properly move past the sensing surface of the sensor with a number of clock pulses output from the clock pulse generator for the duration of the variation rate signal output from the differentiator, and determining a direction of the skew of the sheet with respect to the transport direction from a result of the comparison.

7. A device as claimed in claim 6, in which the single sensor is located in the vicinity of the rightmost end of the transport path with respect to the transport direction, the computer means being constructed to decide that the sheet is skewed rightwardly upwardly (leftwardly downwardly) when the second predetermined number is larger than the number of pulses which appeared for the duration of the variation rate signal and leftwardly upwardly (rightwardly downwardly) when the second predetermined number is smaller than the number of pulses which appeared for the duration of the variation rate signal.

8. A device as claimed in claim 6, in which the single sensor is located in the vicinity of the leftmost end of the transport path with respect to the transport direction, the computer means being constructed to decide that the sheet is skewed leftwardly upwardly (rightwardly downwardly) when the second predetermined number is larger than the number of pulses which appeared for the duration of the variation rate signal and rightwardly upwardly (leftwardly downwardly) when the second predetermined number is smaller than the number of pulses which appeared for the duration of the variation rate signal.

* * * * *